US006986242B2

(12) United States Patent
Antouly

(10) Patent No.: US 6,986,242 B2
(45) Date of Patent: Jan. 17, 2006

(54) DEVICE FOR THE CONTINUOUS CABLING AND SETTING OF YARNS FOLLOWED BY ADDITIONAL HEAT TREATMENT

(75) Inventor: Philippe Antouly, Charmes sur Rhone (FR)

(73) Assignee: Rieter Textile Machinery France, Valence Cedex (FR)

( * ) Notice: Subject to any disclaimer, the term of this patent is extended or adjusted under 35 U.S.C. 154(b) by 0 days.

(21) Appl. No.: 10/899,336

(22) Filed: Jul. 26, 2004

(65) Prior Publication Data

US 2005/0022492 A1 Feb. 3, 2005

Related U.S. Application Data

(63) Continuation of application No. PCT/FR03/00217, filed on Jan. 23, 2003.

(30) Foreign Application Priority Data

Jan. 31, 2002 (FR) ..... 02 01357

(51) Int. Cl.
*D01H 13/28* (2006.01)

(52) U.S. Cl. ..... 57/290; 57/58.52

(58) Field of Classification Search .... 57/58.49–58.86, 57/282, 290

See application file for complete search history.

(56) References Cited

U.S. PATENT DOCUMENTS

| | | | | |
|---|---|---|---|---|
| 3,518,822 A | | 7/1970 | McCard | 57/34 |
| 3,525,205 A | | 8/1970 | Antoni | 57/34 |
| 3,724,039 A | * | 4/1973 | Li et al. | 28/260 |
| 3,775,961 A | * | 12/1973 | Womer | 57/310 |
| 3,817,061 A | | 6/1974 | Bruner | 68/5 |
| 3,820,316 A | | 6/1974 | Clarkson | 57/34 |
| 3,910,027 A | | 10/1975 | Bach | 57/157 |
| 3,987,136 A | | 10/1976 | Schippers | 264/103 |
| 4,034,544 A | | 7/1977 | Clarkson | |
| 4,038,811 A | | 8/1977 | Ansin | 57/34 |
| 4,351,492 A | * | 9/1982 | Aoyama et al. | 242/476.1 |
| 5,950,412 A | | 9/1999 | Gabalda | 57/290 |
| 6,109,015 A | | 8/2000 | Roark | 57/290 |
| 2005/0022495 A1 | * | 2/2005 | Antouly | 57/282 |

FOREIGN PATENT DOCUMENTS

| | | |
|---|---|---|
| EP | 0949363 | 10/1999 |
| FR | 2717505 | 9/1955 |
| FR | 1455499 | 4/1966 |
| FR | 1461120 | 2/1967 |
| FR | 2114546 | 6/1972 |
| FR | 2136336 | 12/1972 |
| FR | 2159554 | 6/1973 |
| FR | 2208999 | 6/1974 |

(Continued)

*Primary Examiner*—John J. Calvert
*Assistant Examiner*—Shaun R. Hurley
(74) *Attorney, Agent, or Firm*—Heslin Rothenberg Farley & Mesiti P.C.

(57) ABSTRACT

The device comprises: a two-for-one twisting spindle supporting a yarn winding which is twisted or cabled via a second yarn; a mechanism for pulling the yarn in order to cancel the tension resulting from the twisting or cabling operation; a heater for heating the yarn followed by a cooling area; and a mechanism for coiling the yarn. The heater comprises at least one cup-shaped element which is associated with a return guide enabling the yarn to be wound. The cup-shaped element is brought to a specific temperature and is positively driven in a state of rotation.

8 Claims, 2 Drawing Sheets

FOREIGN PATENT DOCUMENTS

| | | |
|---|---|---|
| FR | 2302362 | 9/1976 |
| FR | 2732043 | 9/1996 |
| GB | 1132995 | 12/1965 |
| JP | 52114570 | 9/1977 |
| JP | 52114750 | 9/1977 |
| SU | 1432105 | 10/1988 |

* cited by examiner

DEVICE FOR THE CONTINUOUS CABLING AND SETTING OF YARNS FOLLOWED BY ADDITIONAL HEAT TREATMENT

CROSS-REFERENCES TO RELATED APPLICATIONS

This application is a continuation of international application PCT/FR03/00217 filed on Jan. 23, 2003 and published, in French, as international publication number WO 03/064741 A2 on Aug. 7, 2003, and claims priority from French patent application number 02.01357 filed on Jan. 31, 2002, the complete contents of these applications being incorporated herein by reference. This application is also related to commonly owned, concurrently filed application Ser. No. 10/899,516.

The invention relates to a device making it possible to carry out continuously the cabling and setting of continuous yarns.

Such devices are used, for example, by machines making it possible to produce yarns for carpets.

The prior art may be illustrated, as an in no way limiting indication, by the teaching of patents FR 1 455 499 and U.S. Pat. No. 3,525,205. It may be gathered from these documents that such machines comprise a central stand supporting a plurality of identical work stations consisting, as seen in the direction of passage of the yarn, of a single or double twist spindle supporting a package of said yarn, of means for the take-up of the yarn, of a heat treatment oven followed by a cooling zone, and, finally, of means for winding up the treated yarn. The heat treatment oven is arranged vertically (patent FR 1 455 499) or horizontally (U.S. Pat. No. 3,525,205). The yarn is maintained in the relaxed state during heat treatment and during the cooling phase before winding.

The teaching of the patent FR 2 414 568 may also be mentioned, which discloses a machine, in which each work station comprises a double twist spindle followed by a heat treatment oven arranged between two take-up systems followed by winding-up means. Such a machine is used to carry out the drawing of a partially drawn yarn by means of the double twist spindle which rotates at a speed such that the tension imparted to the yarn in the balloon which it forms at the exit of said spindle brings about the drawing of the yarn.

Machines similar to-those described above for carrying out this direct cabling operation are also known. In this case, the yarn coming from the package mounted on the single and/or double twist spindle is combined with a second yarn coming from a second reel mounted fixedly on the stand of the machine. This second yarn is delivered through the shank of the corresponding spindle to a cabling head arranged in the extension of the latter. An advantageous exemplary embodiment of this type of machine makes it possible to carry out both a twisting operation and a cabling operation, as may be gathered from the teaching of the patent FR 2 732 043, of which the present applicant is also the proprietor.

According to the teaching of this patent, the machine comprises a central stand supporting a plurality of identical work stations, each comprising:

- a double twist or cabling spindle supporting a yarn package, said yarn being intended to be twisted or cabled together with a second yarn;
- means for the take-up of the yarn, making it possible to cancel out the tension resulting from the twisting or cabling operation;
- yarn heating means followed by a cooling zone;

- means for winding up the treated yarn;
- the heating means consist of a tilinear oven arranged vertically or substantially vertically;
- the yarn executes an outgoing and return travel within the oven into which the end of said yarn is introduced in its lower part, while a system for the take-up and return for said yarn is provided in the upper part;
- means are provided for maintaining the yarn under minimum tension during the cooling phase and in order to deliver it to the winding-up means.

These arrangements make it possible not only to double the duration of the heat treatment for an oven of given length, but also to control perfectly the tensions imparted to the yarn during the heat treatment and cooling phases.

This latter solution affords important advantages, as compared with the prior art, but nevertheless cannot be considered as entirely satisfactory.

To be precise, in view of the treatment which the yarn must undergo, the oven has to be brought to a relatively high temperature of the order of 210° C. and must have large dimensions. For example, the length or height of the oven may amount to 4.50 meters. It is necessary, moreover, to provide substantial means for ensuring the cooling of the yarn in the relaxed state. For example, such means may consist of a relaxation cloth arranged horizontally underneath the oven. This cloth may either be individual for each work station or be common to all the stations and in that case extend over the entire length of the machine.

Proceeding from this prior art, the problem which the invention proposes to solve is to dispense with the oven, thus making it possible to manage without dimensional characteristics, while at the same time having the aim of heating the yarn to a lesser extent so as to have to cool it to a lesser extent, thus making it possible also to reduce the power of the installation.

In order to solve such a problem, a yarn cabling and/or double twist device has been designed and refined, of the type comprising in a known way:

- a double twist or cabling spindle supporting a yarn package, said yarn being intended to be twisted or cabled together with a second yarn;
- means for the take-up of the yarn in order to cancel the tension resulting from the twisting or cabling operation;
- yarn heating means followed by a cooling zone;
- means for winding up the yarn.

According to the invention, and in light of the set problem to be solved, the heating means consist of at least one cylindrical godet associated with a return guide for allowing a reeving of the yarn, said godet being brought to a defined temperature and being driven positively in rotation.

In light of the set problem, in order to simplify the cooling means, the cooling zone comprises at least one cylindrical godet/return guide assembly ensuring the reeving of the yarn, said assembly being located between the heating godet and the winding-up means.

Another problem which the invention proposes to solve is that of improving the efficiency of the heating means according to the invention.

For this purpose, the device comprises, between the take-up means and the heating godet, a means for applying a heat exchange fluid to the yarn.

Another problem which the invention proposes to solve is that of improving the "bulk" of the cabled yarn.

For this purpose, the cylindrical godet and the return roller have spaced slots formed parallel to their axis of rotation. The bottom of the slots is rounded so as to form grooves.

The invention is explained in more detail below with the aid of the figures of the accompanying drawing in which.

Figure 1:
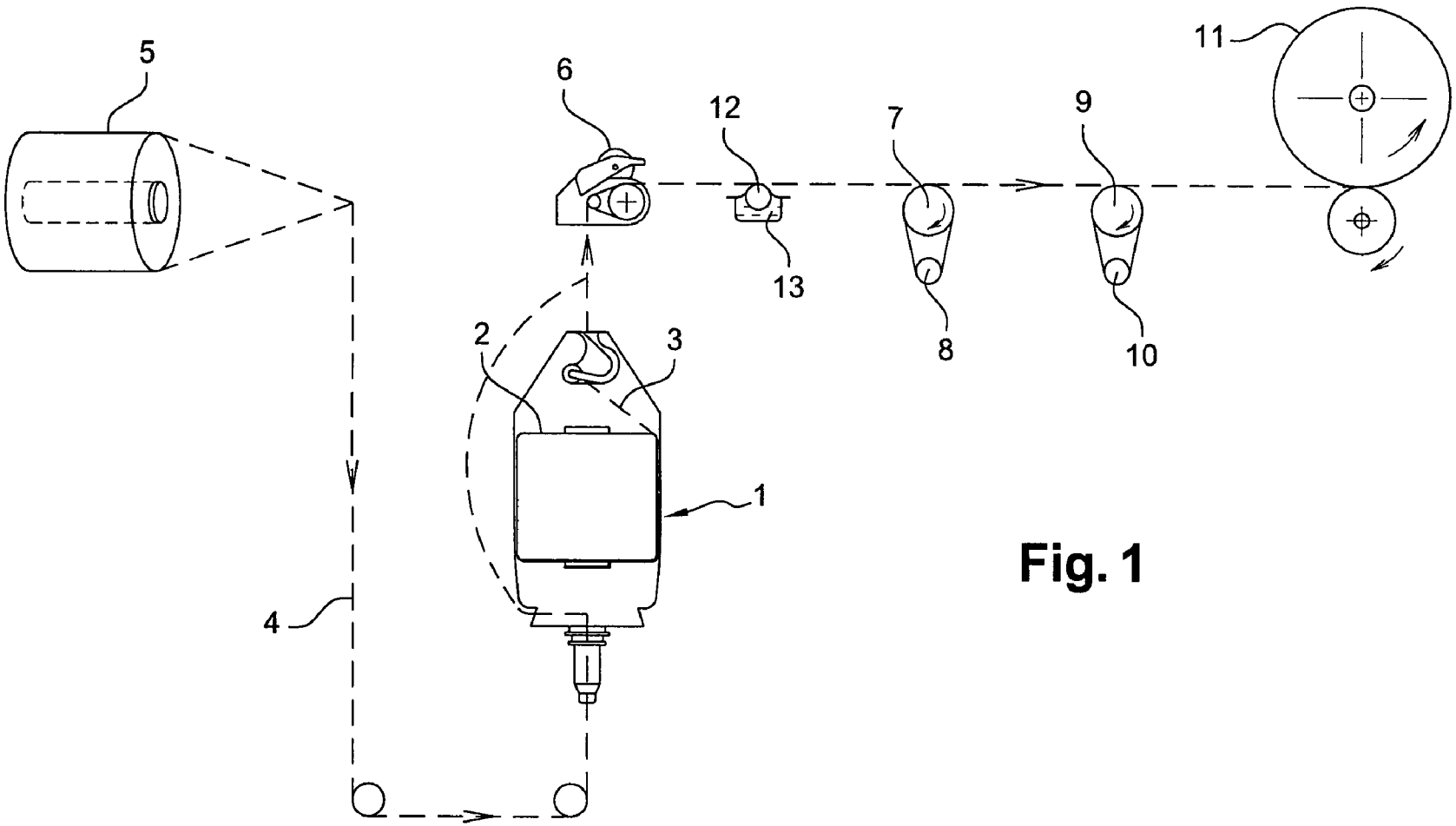
FIG. 1 is a diagrammatic view showing the principle of the device according to the invention for carrying out the continuous cabling and setting of yarn.
Figure 3:
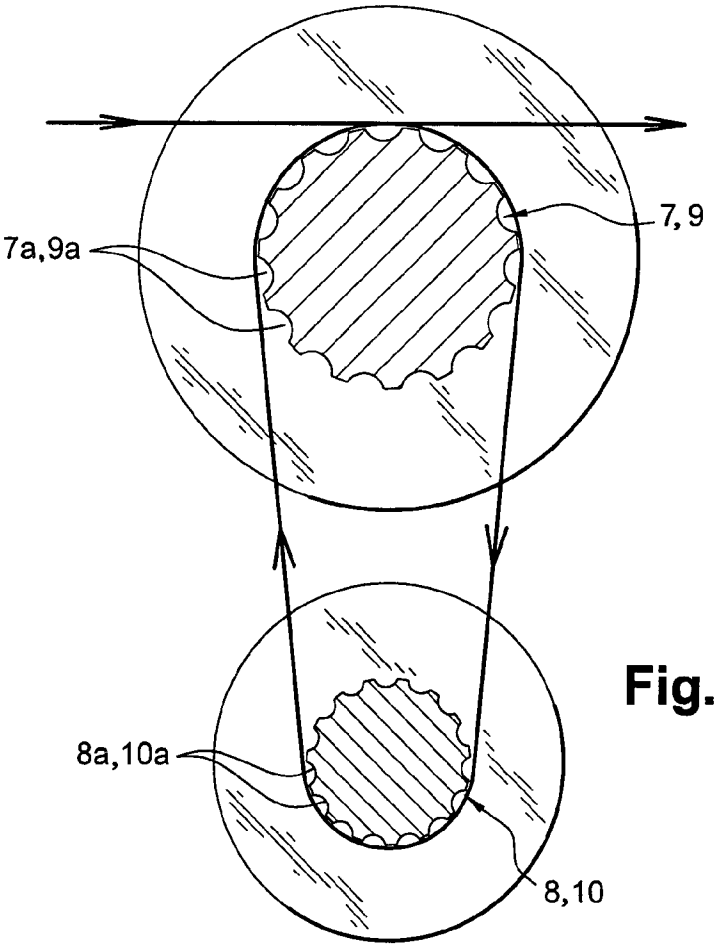
FIG. 3 is, on a larger scale, a cross-sectional view taken along the line 3—3 of FIG. 2.
Figure 2:
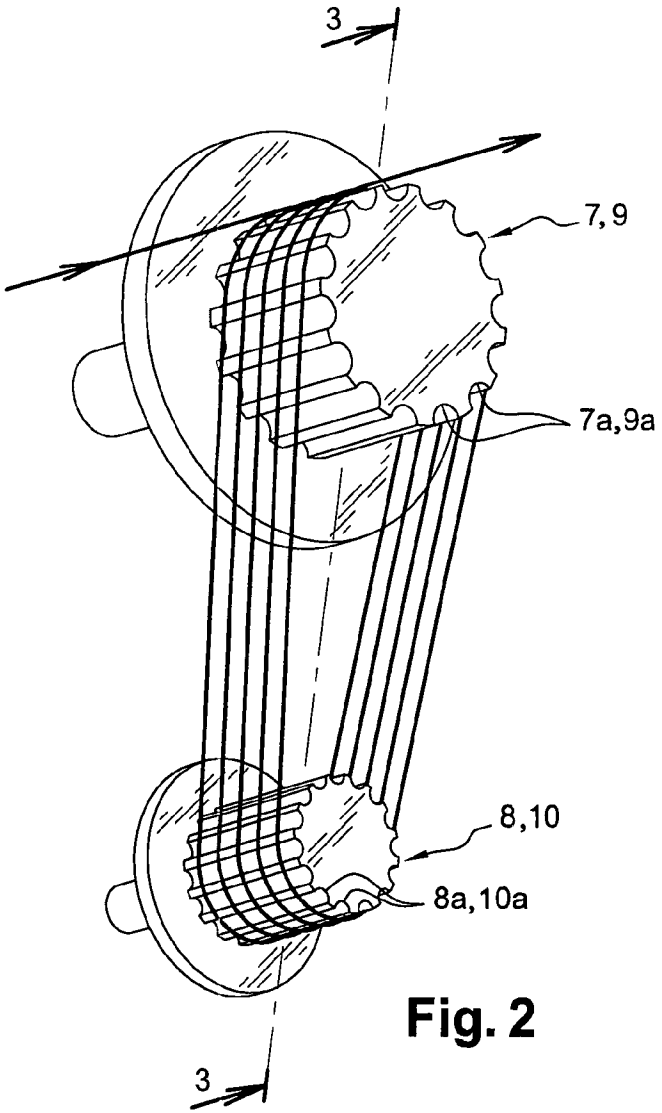
FIG. 2 is a perspective view of an advantageous embodiment of the heating and cooling means.

As shown in FIG. 1, the device comprises, in a known way, a double twist or cabling spindle (1) making it possible to carry out either twisting or a direct cabling operation. The spindle, driven by any known appropriate means, receives a reel (2) of a first yarn to be treated (3), called the "can yarn". To carry out the direct cabling operation, the spindle (1) has a hollow shank for delivering a second yarn (4), called the "creel yarn" coming from a reel (5). Thus, in a known way, the creel yarn (4) is delivered through the hollow shank of the spindle so as to be combined with the can yarn (3) in the region of a cabling head (6).

The cabling head (6) is of any known and suitable type. At its exit, the yarns (3) and (4) are assembled by means of the conventional direct cabling method. It should be noted that the cabling head (6) may be combined with take-up means making it possible to cancel out the tension resulting from the cabling or from the twist. For example, as taught by the abovementioned French patent FR 2 732 043, the take-up means may be composed essentially of an assembly of the type comprising a capstan and a press roll. The combination with a grooved roll makes it possible to obtain a reeving of the cabled yarn. This results in a very high accuracy in the take-up speed of the yarns and also in a cancelation of the tension resulting from the twisting or cabling operation.

According to the invention, the means for the heat treatment of the cabled yarn (3–4) consist of at least one cylindrical godet (7) associated with a return guide (8) for allowing a reeving of the yarns. The godet (7) is brought to a defined temperature and is driven positively in rotation.

At the exit of the heating means (7) and (8), the treatment device has a cooling zone likewise consisting of the combination of a cylindrical godet (9) and of a return guide (10). At the exit of the cooling zone (9) and (10), the yarn is wound onto a reception means in the form of a reel (11).

As mentioned, the godet (7) is associated with heating means making it possible to maintain it at a predetermined temperature. For example, these heating means are of the induction type, making it possible to maintain the godet within a predetermined temperature range, for example between approximately 90° C. and 240° C. The godet (7) is driven in rotation by any known and suitable means. The return roller (8) is mounted rotatably.

In an important way, the godet (7) and the guide roller (8) have spaced slots **(7*a*) and (8*a*)** formed parallel to their axis of rotation.

These arrangements make it possible to increase and improve the bulking effect of the cabled yarns (3–4).

In the same way, the godet (9) and the return roller (10) have spaced slots **(9*a*) and (10*a*) formed parallel to their axis of rotation. It should be noted that the godet (9)** relating to the cooling zone may be brought to a temperature of between approximately 55° C. and 130° C.

The various slots of the godets (7) and (9) and of the return rollers (8) and (10) are rounded so as to form grooves. As regards the slots, various embodiments may be provided, for example in terms of their dimensioning. The slots may be of the same depth or not. Advantageously, the slots are distributed uniformly on the circumference of the godet and of the return roller, without thereby ruling out an unequal distribution. Finally, these slots are parallel to one another or not.

The various solutions applied with regard to the godets (7) and (9) may be considered with regard to the return rollers (8) and (10).

Upstream of the heating means (7) and (8), at the exit of the cabling assembly (6), the yarns (3) and (4) are subject to the action of a roller (12) or other means capable of applying a heat exchange fluid (13) to the yarns (3–4).

It should be noted that the shape of the heating godet is designed for the shrinkage of the yarn. For example, the heating godet may have a plurality of diameters or be cylindrical, conical, etc.

The advantages become apparent from the description, and, in particular, the elimination of the traditional oven is emphasized and recalled, making it possible, in particular, to reduce the overall size of the device as a whole considerably.

What is claimed is:

1. A device for continuous cabling and setting of yarns followed by an additional heat treatment, comprising:

a double twist or cabling spindle supporting a first yarn, said first yarn being twisted or cabled together with a second yarn to produce a twisted or cabled yarn;

means for take-up of a yarn in order to cancel out tension resulting from a twisting or cabling operation resulting in the twisted or cabled yarn being in a relaxed state;

yarn heating means followed by a cooling zone;

means for winding up the twisted or cabled yarn, wherein the heating means comprises at least one heating godet associated with a return guide or roller for allowing a reeving of the twisted or cabled yarn, said godet being brought to a defined temperature and being driven positively in rotation; and said at least one heating godet receiving the twisted or cabled yarn in the relaxed state from the means for take-up of the yarn.

2. The device as claimed in claim 1, wherein the cooling zone comprises an assembly of at least one godet and a return guide or roller ensuring the reeving of the yarn, said assembly being located between the heating godet and the winding-up means.

3. The device as claimed in claim 1, further comprising, between the take-up means and the heating godet, a means for applying a heat exchange fluid to the yarn.

4. The device as claimed in claim 1, wherein the godet and return guide or roller have spaced slots formed parallel to their axis of rotation.

5. The device as claimed in claim 4, wherein a bottom of the slots is rounded so as to form grooves.

6. The device as claimed in claim 5, wherein the grooves are distributed uniformly or not on a circumference of the godet and of the return guide or roller.

7. The device as claimed in claim 6, wherein a bottom of the grooves delimits a diameter of same value or not.

8. A use of the device as claimed in any one of claims 1 to 7 for producing cabled yarns and twisted yarns for carpets.

* * * * *